US007267036B1

(12) United States Patent
Barr et al.

(10) Patent No.: US 7,267,036 B1
(45) Date of Patent: Sep. 11, 2007

(54) VIAL CARD SLITTING APPARATUS

(76) Inventors: Wayne R. Barr, 2390 Golf Vista Blvd., Viera, FL (US) 32955; Rory Westlund, 12400 44th St. North, Clearwater, FL (US) 34622; Paul O. Wright, 3116 Roxmere Dr., Palm Harbor, FL (US) 34685; Kelly Mc Gaughey, 6320 92nd Pl., Apt 2603, Pinellas Park, FL (US) 33782

( * ) Notice: Subject to any disclaimer, the term of this patent is extended or adjusted under 35 U.S.C. 154(b) by 429 days.

(21) Appl. No.: 10/815,359

(22) Filed: Apr. 1, 2004

(51) Int. Cl.
*B26D 1/03* (2006.01)

(52) U.S. Cl. ..... 83/102; 83/166; 83/858

(58) Field of Classification Search ..... 83/857, 83/858, 106, 107, 104, 147, 149, 166
See application file for complete search history.

(56) References Cited

U.S. PATENT DOCUMENTS 3,217,768 A * 11/1965 Lamb ..... 83/404.2
3,491,633 A * 1/1970 White ..... 83/23
5,255,583 A * 10/1993 Andrews ..... 83/39
6,308,604 B2 * 10/2001 Guzowski ..... 83/257
7,051,633 B2 * 5/2006 Weiler ..... 83/425.3

* cited by examiner

*Primary Examiner*—Kenneth E. Peterson
(74) *Attorney, Agent, or Firm*—Robert O. Wright

(57) ABSTRACT

A device for separating individual containers from a group of multiple containers and delivering the separated individual container for further processing is shown. The device relies in part on gravity for the movement of the containers.

10 Claims, 8 Drawing Sheets

VIAL CARD SLITTING APPARATUS

This invention relates to apparatus for separating individual containers from an assembly of containers. More particularly this invention relates to apparatus for slitting a card having a number of vials containing a desired substance into individual vials of said substance.

BACKGROUND OF INVENTION

In many fields it is convenient and/or economical to manufacture and package individual units of a product such as dose of medicine, in cards or packs of some multiple of the individual units. At the same time it is becoming important to be able to identify and track individual units. In the medical field it is often mandatory to identify individual doses of a medicine and lately proof that the proper medicine is dispensed to the proper patient. To accomplish this each individual dosage of a medication must be identified, by a bar code for instance, along with date of manufacture, lot number, plant, shift etc. Where the individual dosages have been manufactured in multiples on a card they must be separated into individual vials and packaged individually with the coded information applied to each individual package.

PRIOR ART

Cards of multiple packs of dosage vials have been torn apart in some cases manually and others by machine manipulation. Others have tried to separate the individual vials by die cutting of the cards on a platen. These at best have been difficult, cumbersome, and expensive operations.

OBJECTS OF PRESENT INVENTION

It is therefore an object of the present invention to provide an improved apparatus and method for separating individual units from an assembly of multiple units.

It is another object of the present invention to provide a novel apparatus for slitting cards of multiple vials of a substance into individual vials It is a still further object of the present invention to provide a novel apparatus and method of slitting individual vials from a card of six vials taking advantage of the force of gravity.

It is still another object of the present invention to provide a novel apparatus that can slit individual vials from cards of vials containing different numbers of vials.

These and other and further objects of the invention are accomplished in one embodiment in which the card of vials to be slit into individual vials is fed by gravity into a generally vertical chute from which the card is pushed through a series of vertical partitions to separate the individual vials from the card and feed them into individual chutes from which they are fed sequentially into a machine for further processing of the individual vials.

BRIEF DESCRIPTION OF THE DRAWINGS

FIG. 8 is a view similar to FIG. 7 showing a single vial being released for individual packaging from a set of six separated vials; and.

DESCRIPTION OF A PREFERRED EMBODIMENT

Figure 1:
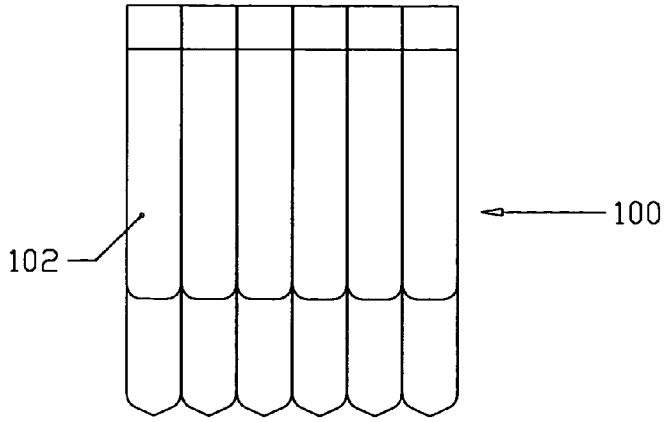
FIG. 1 is a perspective view of a card of six vials to be separated.
Figure 2:
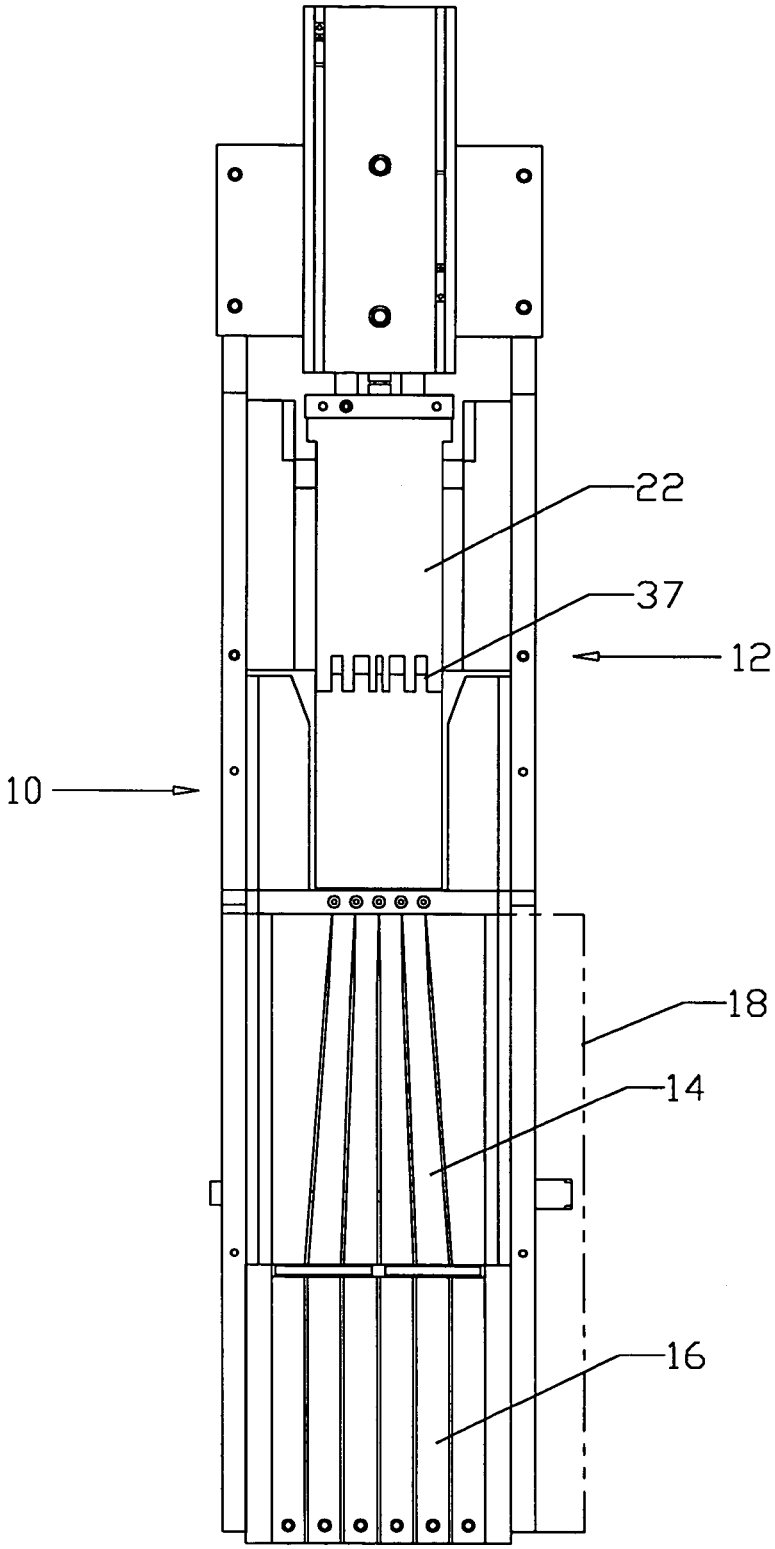
FIG. 2 is a front elevation of the present invention.
Figure 3:
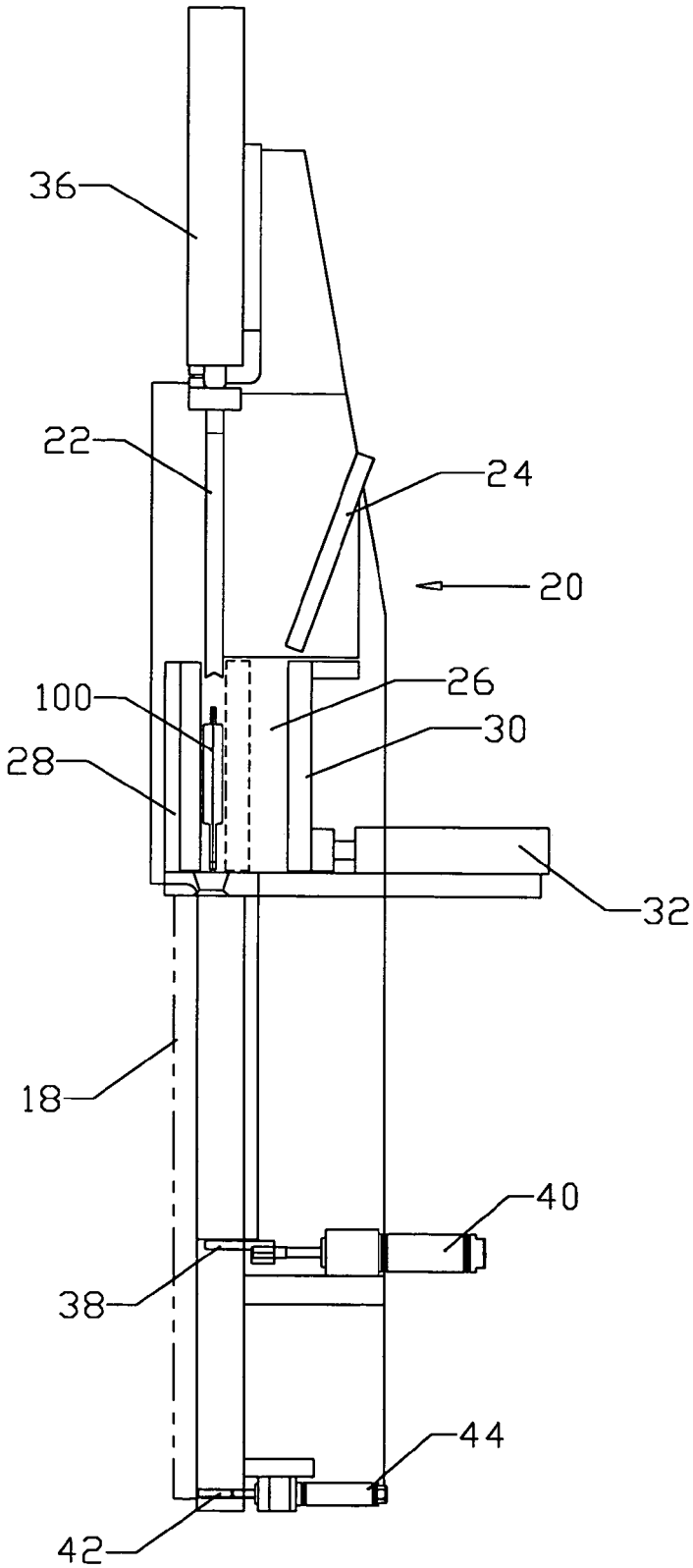
FIG. 3 is a side elevational view with sides removed, taken on line 3—3 of FIG. 1.

FIG. 1 shows a typical packet or card 100 having six vials, each containing a single dose of a medicine, frangibly inter connected along the side edges in the manufacturing and filling process, which must be separated and packaged individually. Referring now to FIGS. 2 and 3 slitting apparatus 10 includes a chute assembly 12 which is positioned in a generally vertical position but with a slight offset from the vertical to ensure the vials after separation will lie smoothly in their respective channels 14 and 16. A transparent cover 18 is usually used to close the channels 14 & 16 also.

Figure 5:
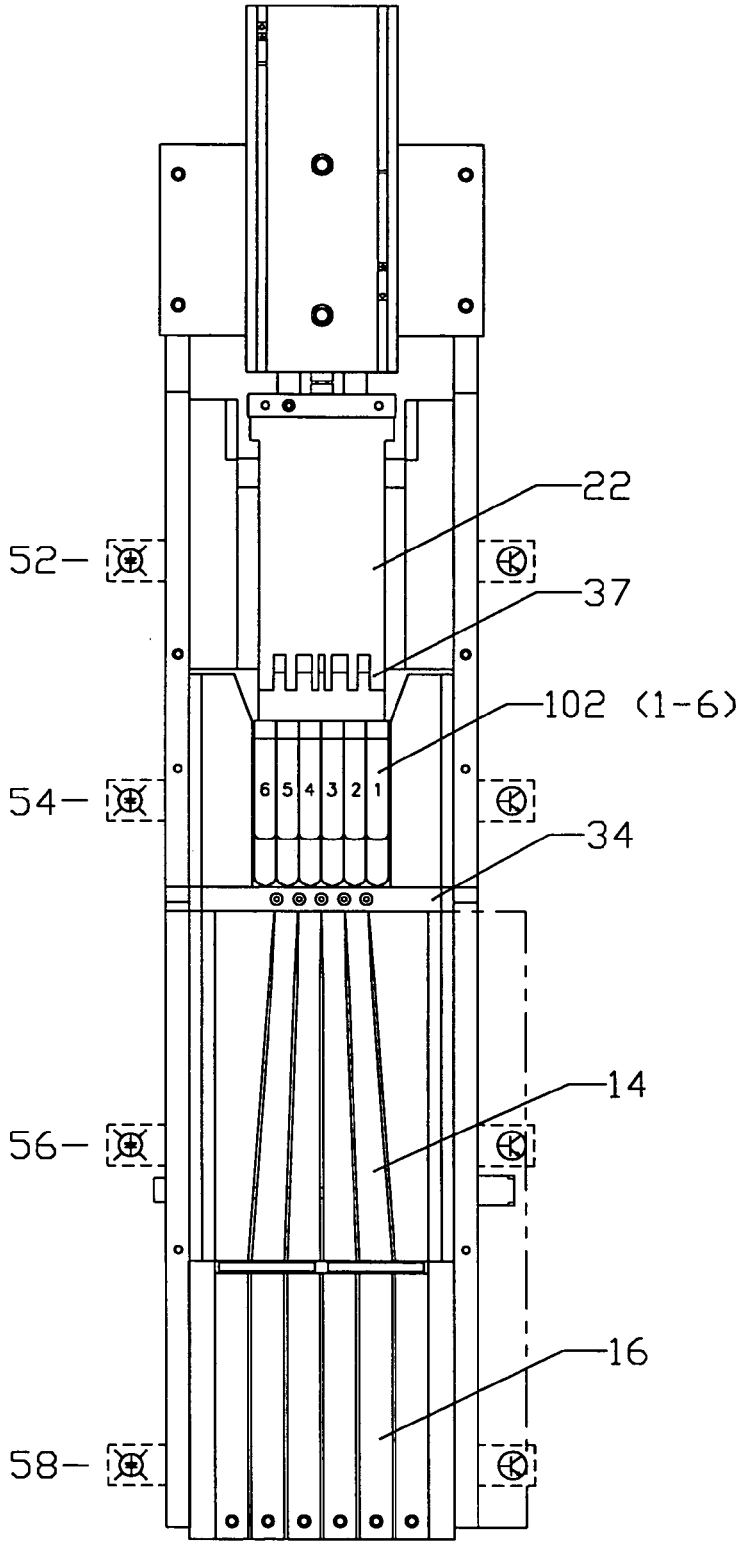
FIG. 5 is a view similar to FIG. 2 showing a card of vials ready to be separated.

Mounted on the upper end of chute assembly 12 is a hopper 20 comprised of a back member 22 and a front member 24 slanted at an angle of some twenty to thirty degrees from the back member so that a card 100 may be dropped into the hopper and it will be deflected to a generally vertical position and drop down under gravity into chamber 26. Chamber 26 has a fixed back wall 28 and a movable front wall 30 which is moved from an open to a closed position (shown in dotted lines in FIG. 3) by an actuator 32. Actuator 32 and other actuators herein may be pneumatic, hydraulic, or solenoid powered as best suited to the particular installation environment. When the chamber wall 30 is in the open position shown in solid lines in FIG. 3, a card 100 dropped into hopper 20 will drop down into the open space between walls 28 and 30. Actuator 32 is then actuated to move wall 30 to the closed position shown in dotted lines in FIG. 3. This positions the card 100 in the proper vertical position with the vials 102 standing vertically and aligned within the back of chamber 26. (See also FIG. 5)

A separating assembly 34, including a series of five vertical partitions 35, is positioned transversely across the bottom of the closed chamber 26. Partitions 35 are spaced apart a distance equal to the spacing of the vials 102 in the card 100 and aligned with the frangible connections holding the vials 102 together so as to separate them when card 100 is pushed therethrough. To aid in this action the separating partitions have a vertical height generally equal to the thickness of the holder and a thickness similar to that of a knife blade.

To ensure complete separation the bottom of pusher 22 carries typically five fingers 37 which have a vertical height equal to the height of the separating assembly and a width less than the space between the partitions.

Figure 6:
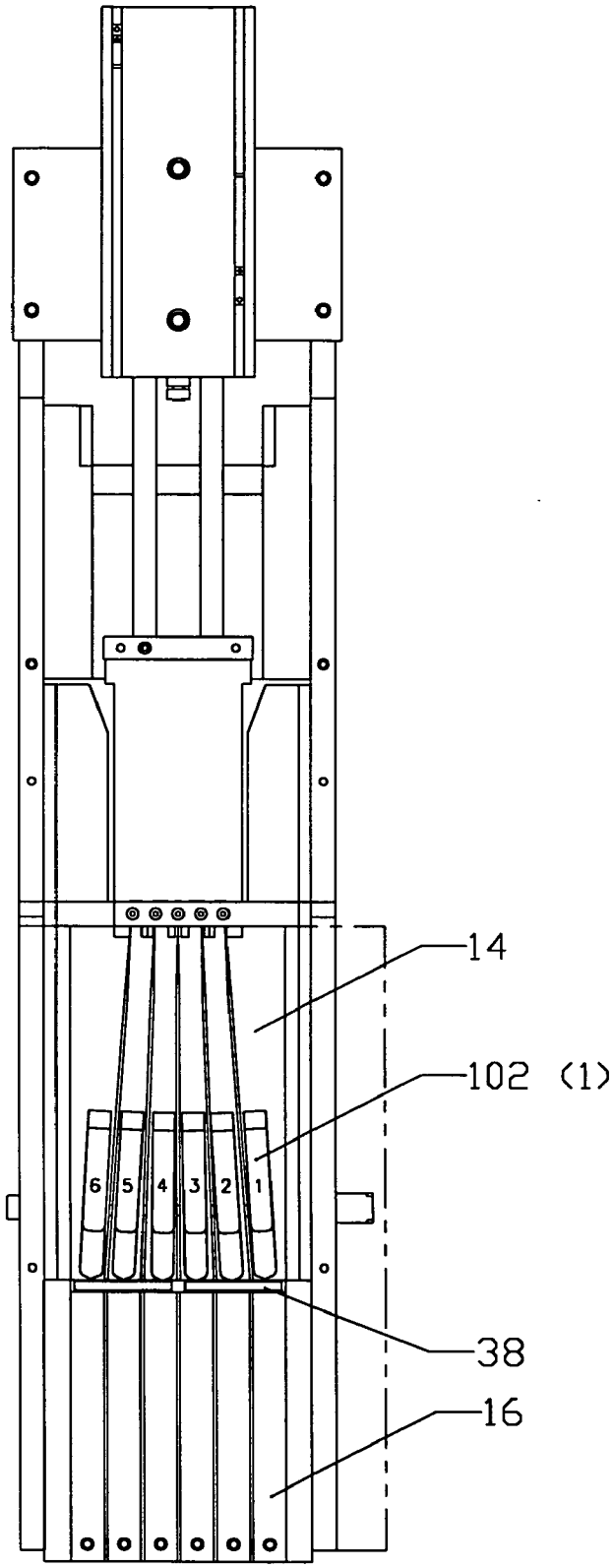
FIG. 6 is a view similar to FIG. 5 showing the separated vials in the next station.

In operation actuator 36 is energized to drive back wall 22 (also called "the pusher") of hopper 20 downwardly pushing the card 100 of vials 102 through the partition assembly 34 causing them to be separated into individual vials 102 one through six. As shown in FIG. 6 the severed vials 102(1–6) then fall by gravity into the diverging channels 14 until stopped by movable doors 38. The doors 38 at the bottom of diverging channels 14 may be individual doors for each channel or just two doors covering three channels each. In either configuration the doors are each connected to a actuator 40 and are controlled by the system shown in FIG. 4.

Figure 4:
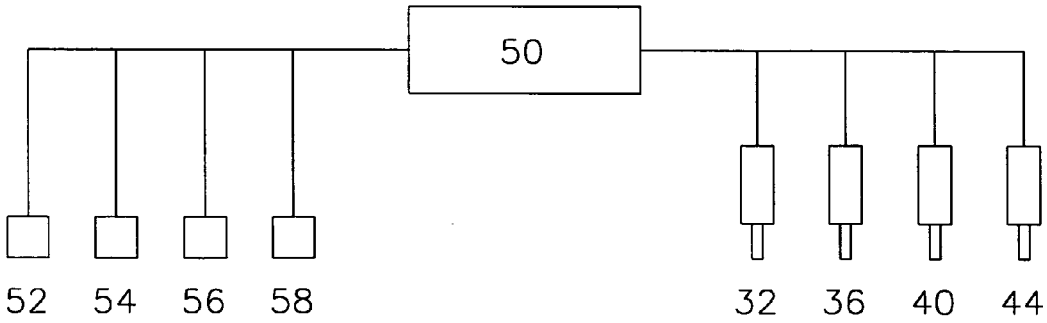
FIG. 4 is a block diagram of the controls for the apparatus of FIG. 1.
Figure 7:
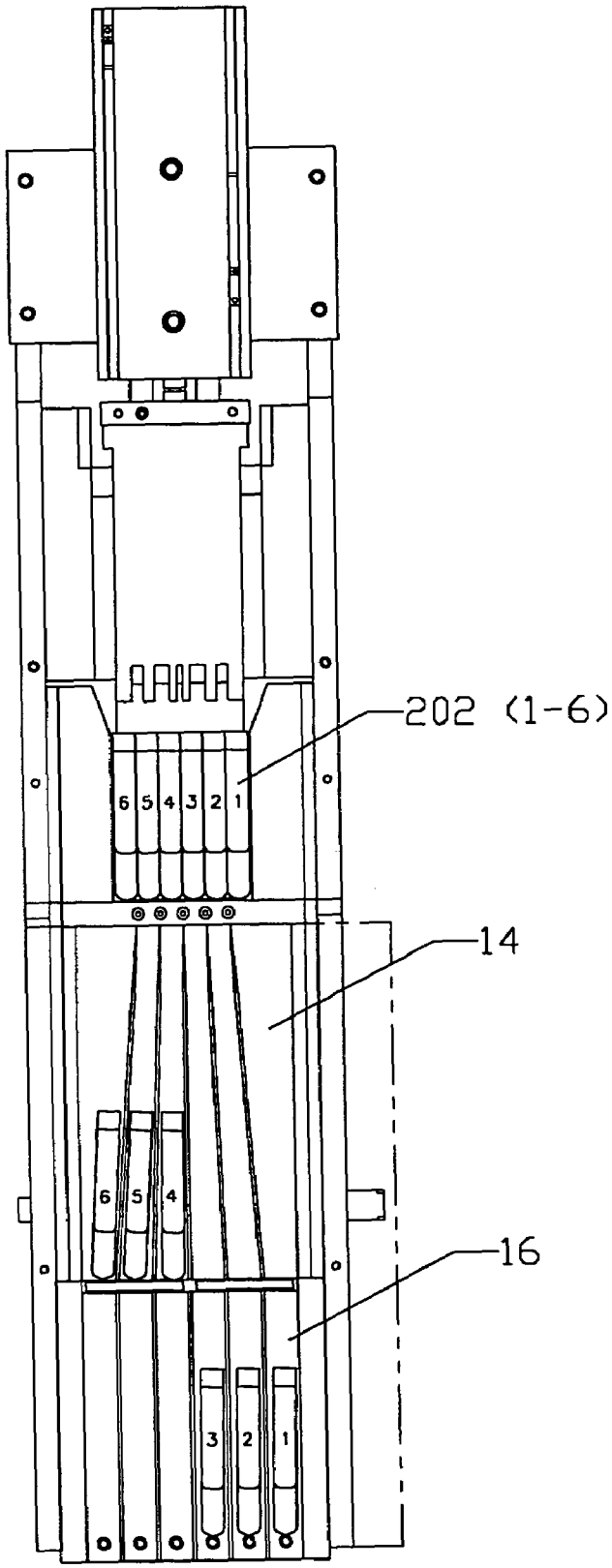
FIG. 7 is a view similar to FIG. 6 after one half of the vials have been released to the next station.

The six lower channels 16 similarly have six doors 42 connected to six actuators 44 and controlled by the system of FIG. 4. Typically the doors 42 are retracted one at a time in sequence to release the vials 102(1–6) one at a time (see FIGS. 7 & 8) for individual packaging in a separate packing machine not shown.

Figure 8:
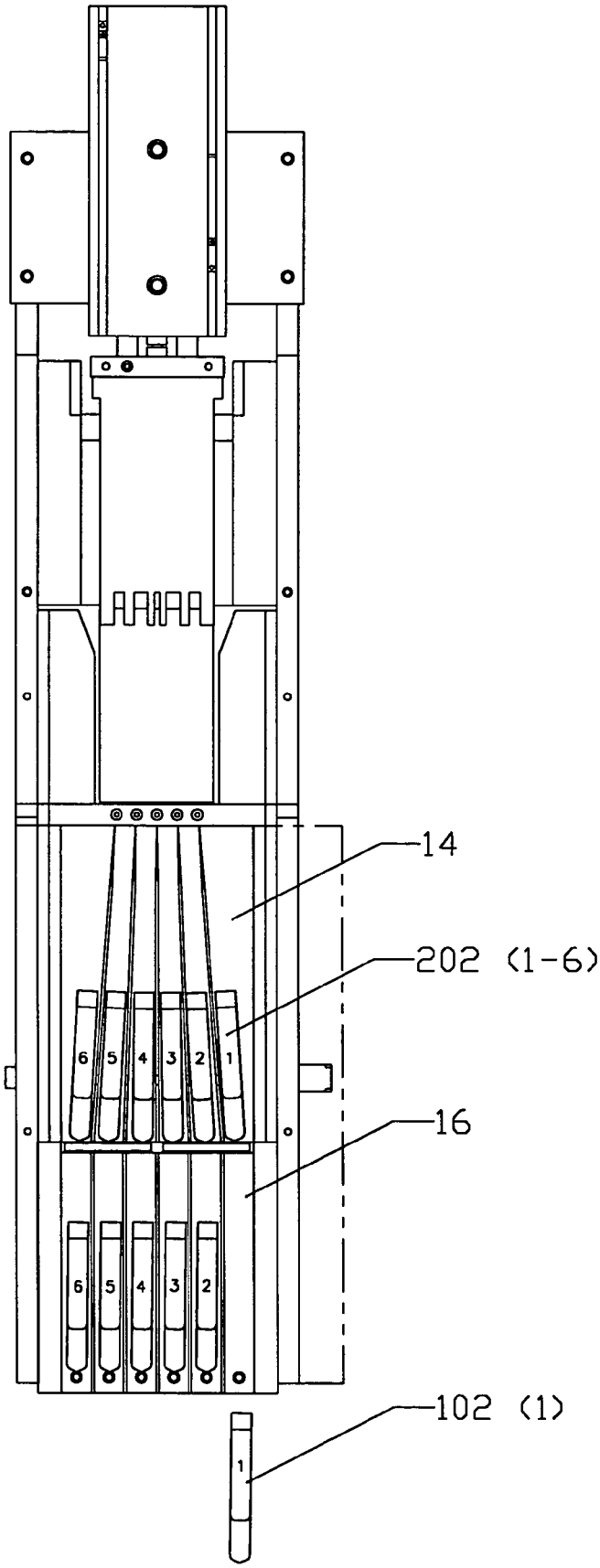

In a typical operation as shown in FIGS. 5–8 a first packet or group 100 of six vials 102(1–6) are pushed downwardly through the separating assembly 34 and the severed vials 102(1–6) are dropped into the diverging channels 14 as shown in FIG. 6. If there are no vials in channels 16 one half of the vials, the right hand vials 1–3 for instance, are released to the channels 16 (see FIG. 7) and then the three left vials 4–6 are released to the channels 16. The vials 102(1–6) of the first packet 100 in channels 16 are then released one at a time to the packaging machine. In FIG. 8 vial number 102-1 of group 100 is shown being released to the wrapping machine.

While this is taking place the next packet 200 of vials 202(1–6) may be positioned in hopper 26 ready to be pushed through the separating assembly 34. As soon as vials 100 (4–6) are dropped into channels 16 packet 200 is pushed through separating assembly 34 and the severed vials 202 (1–6) of packet 200 dropped into channels 14. The vials in channel 16 are released one at a time and as soon as the three right hand vials 1–3 of packet 100, in channels 16, are released to the packaging machine the right hand three vials 202(1–3) of packet 200 in channels 14 are released to the channels 16. The vials 202(1–6) in packet 200 were separated after vials 102(4–6) were dropped from channel 14 into channel 16 as indicated above. Similarly as soon as the three left hand vials 102(4–6) are emptied from channels 16 the left hand three vials 202(4–6) of packet 200 in channels 14 are dropped into channels 16. This sequence of operation as shown in FIGS. 5–8 permits a greater thru put of packets than possible with a single set of channels.

As shown in FIG. 4 the above sequence of operations is controlled by a computer 50 which is connected to the actuators 32, 36, 40, & 44 and a series of sensors 52, 54, 56, & 58 positioned in compartments 20 and 26 together with sensors for each of the channels 14 and 16. As the channel 14 and 16 sensors indicate availability the computer 50 actuates the appropriate actuator to move the packets 100, 200 etc. as received in compartment 20 through the above described sequence of operations.

Figure 9:
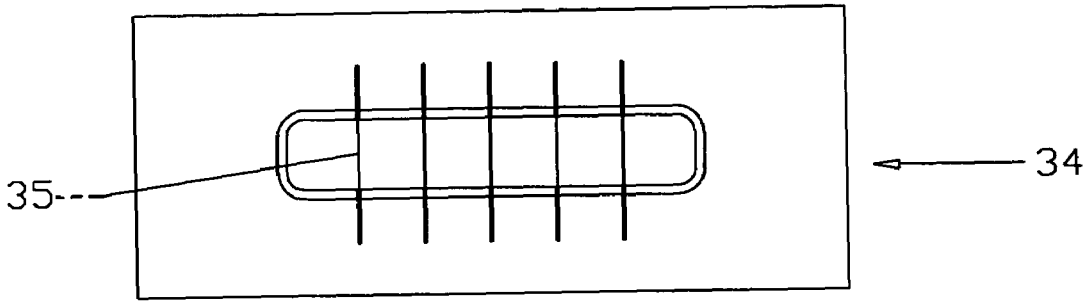
FIG. 9 is a top plan view of the separating assembly.

While FIG. 9 shows a series of vertical partitions in the separating assembly 34, in some applications we have found that small diameter wires may be substituted for the partitions 35 in the separating assembly without significantly compromising the desired separation.

When it is desired to separate groups or cards of vials or other containers of less than six the chute assembly 12 may be removed and another assembly inserted. The substitute assembly will have the same outer dimensions with only the interior slot widths and positions altered to direct the vials to be separated into the selected channels in channel assemblies 14 and 16. Similarly different shapes and sizes of containers may be accommodated.

While there are given above certain specific examples of this invention and its application in practical use, it should be understood that they are not intended to be exhaustive or to be limiting of the invention. On the contrary, these illustrations and explanations herein are given in order to acquaint others skilled in the art with this invention and the principles thereof and a suitable manner of its application in practical use, so that others skilled in the art may be enabled to modify the invention and to adapt and apply it in numerous forms each as may be best suited to the requirement of a particular use.

We claim:

1. An apparatus for separating individual containers from a plurality of containers frangibly joined together in a planar packet which comprises:

a vertically positioned chute assembly having a plurality of operational stations sequentially arranged in descending order from top to bottom;

said chute assembly having a width slightly larger than the width of a packet to be separated into individual containers;

a first chute operational station having an inclined input ramp for receiving a packet and directing it into an alignment station within said vertical chute;

a horizontally movable platen member forming one vertical wall of said alignment station and with said chute assembly a chamber to hold the packet to be separated;

first power means for selectively moving said platen member into contact with the packet to be separated and position it in proper alignment in said alignment station;

a container separating assembly mounted adjacent the lower end of said alignment station and extending across the width of said chute assembly;

a plurality of vertical partitions spaced apart transversely across said separating assembly so as to permit the passage there between of individual containers;

a vertically movable ram member mounted at the top of said alignment station having a width and thickness substantially equal to that of the packet to be separated and adapted to move vertically downwardly into said alignment station;

second power means for selectively moving said ram member to push the packet to be separated positioned in said alignment station through said plurality of vertical partitions in said container separating assembly;

a first holding and guiding station position below said separating assembly having a plurality of vertical channels at least equal to the number of individual containers in the plackets to be separated;

at least one horizontally movable gate member forming the bottom of said first holding station;

third power means for selectively moving said gate member out of the bottom of said first holding station to allow passage there through of separated containers;

a second holding and guiding station positioned below said first holding station having an equal number of vertical channels formed in alignment with the channels in said first holding station;

a plurality of individual horizontally movable gate members positioned one each to form the bottom of said second holding station vertical channels;

fourth power means for selectively moving said plurality of individual gate members out from the bottom of said channels to allow individual containers to pass there through;

a funnel shaped guiding station formed below said second holding and guiding station having a width at the top equal to the width of said second holding and guiding station and a bottom width greater than an individual container; and control program means for selectively actuating said first through fourth power means to sequentially operate the stations of said chute assembly to separate the packet of containers into individual containers.

2. The apparatus as claimed in claim 1 wherein said first through fourth power means are solenoid operated piston rods with said fourth power means piston rods forming said gate members and said first and second and third power means piston rods being attached to said platen, gate and ram members respectively.

3. The apparatus as claimed in claim 2 wherein said at least one horizontal movable gate member comprises at least two sections for allowing passage of less than all of the separated individual containers at one time.

4. The apparatus as claimed in claim 1 wherein said planar packet comprises six small elongated vials joined together with small frangible web tabs at spaced intervals along the length thereof.

5. The apparatus as claimed in claim 1 wherein said vertical partitions of said separating assembly have a vertical height substantially equal to the vertical height of said separating assembly.

6. The apparatus as claimed in claim 1 wherein said separating assembly and said first and second holding stations have operating spaces for six individual containers.

7. The apparatus as claimed in claim 6 wherein said planar packet comprises less than six small elongated vials frangibily joined together.

8. The apparatus as claimed in claim 7 wherein while said control program causes said ram member to place all the separated individual containers from a packet into said first holding station, and then releases approximately one half of the separated individual containers from said first holding station into said second holding station and while said second holding station is releasing said approximately one half of the separated individual containers held therein to said funnel station, said first holding station releases the rest of said packet individual containers into said second holding station allowing said ram member to start another cycle.

9. The apparatus as claimed in claim 1 wherein said first chute station, separating assembly and said first holding station comprise a quick release removable subassembly whereby different size and shape containers may be accommodated by interchanging subassemblies.

10. The apparatus as claimed in claim 1 wherein said vertically movable ram member includes a plurality of fingers formed across the bottom edge thereof; and said fingers having a length equal to the height of said separating assembly and a width less than the distance between said vertical partitions.

* * * * *